United States Patent [19]

Quillen

[11] Patent Number: 4,620,429

[45] Date of Patent: Nov. 4, 1986

[54] CYCLE LOCK

[76] Inventor: John D. Quillen, 790 Woodland Ave., San Leandro, Calif. 94577

[21] Appl. No.: 796,773

[22] Filed: Nov. 12, 1985

[51] Int. Cl.[4] ..... E05B 25/00

[52] U.S. Cl. ..... 70/383; 70/377; 70/406; 70/411; 70/421; 70/366

[58] Field of Search ..... 70/365–366, 70/377, 382–383, 406, 411, 419, 421

[56] References Cited

U.S. PATENT DOCUMENTS 3,255,620 6/1966 Quillen ..... 70/383

3,439,516 4/1969 Quillen ..... 70/383

*Primary Examiner*—Robert L. Wolfe

*Attorney, Agent, or Firm*—Linval B. Castle

[57] ABSTRACT

A cycle lock having at least one plurality of disc-like tumblers loosely mounted on a shaft parallel with the axis of rotation of the key rotated lock cylinder. Each tumbler has a two spaced lobes which, in the neutral state of the tumbler, contact the arcuate surface of the cylinder but one of the lobes may drop into the key slot in the cylinder if not occupied by a high segment on the key. A key is initially inserted into the lock at a special location at which all tumblers are in their neutral state, and the rotation of the key to its normal position of insertion and removal will set the lock tumblers according to the key coding. In one embodiment particularly useful for hotels, etc., two sets of tumblers are employed: one set for transient or guest keys, a second set for service personnel keys, and a third key, a grand master key, operates the second tumbler set and can reset both sets of tumblers for accepting new keys with different codings thereon.

17 Claims, 38 Drawing Figures

FIG-1-
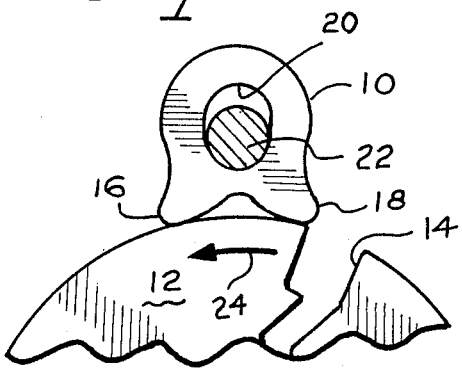
FIG-2-
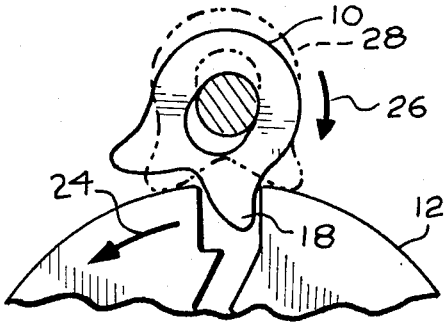
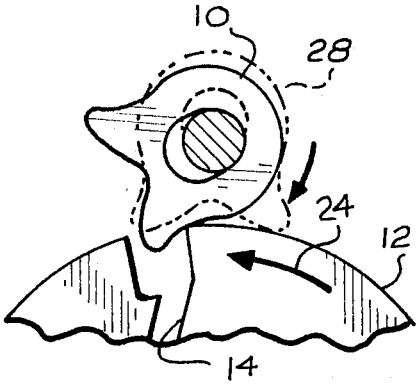
FIG-3-
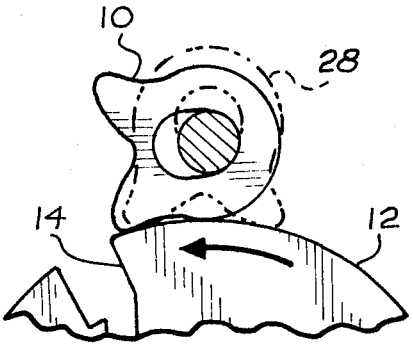
FIG-4-
FIG-5-
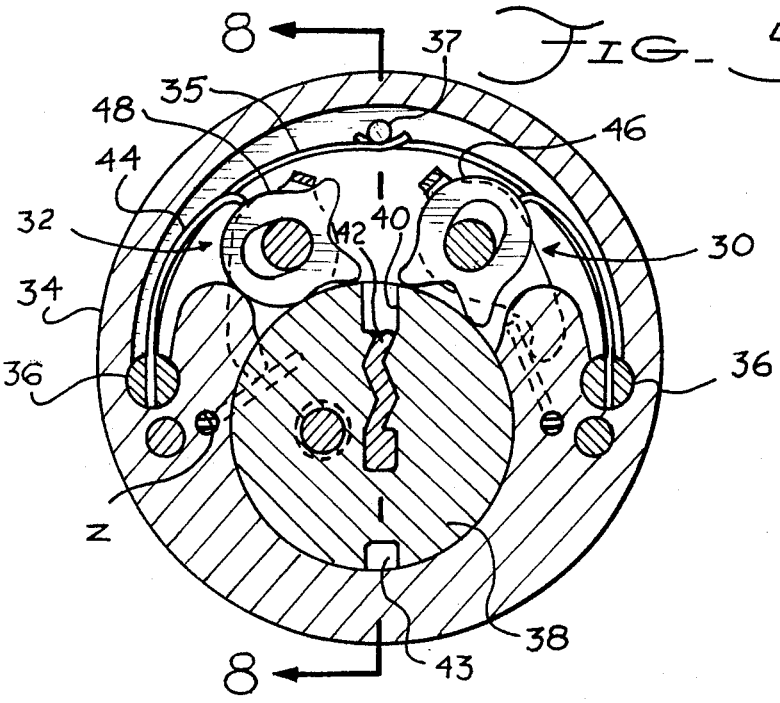

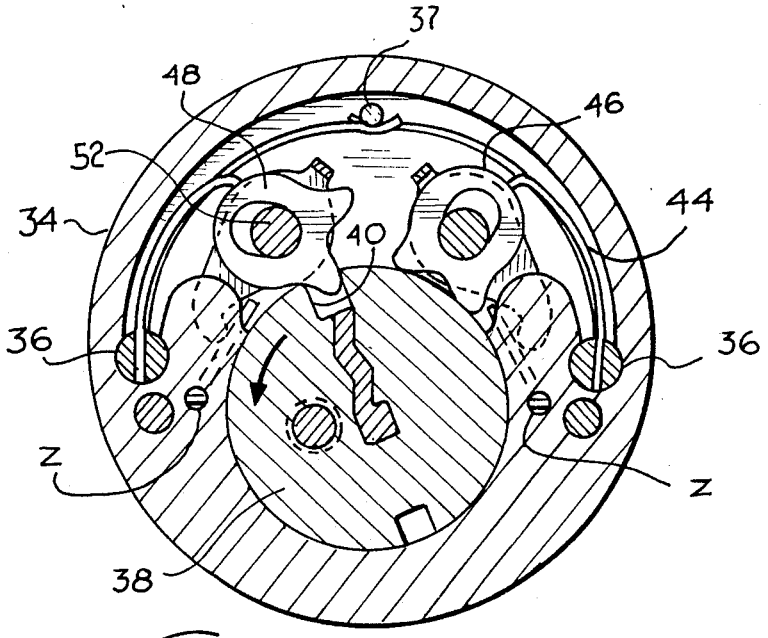
FIG-6-
FIG-7-
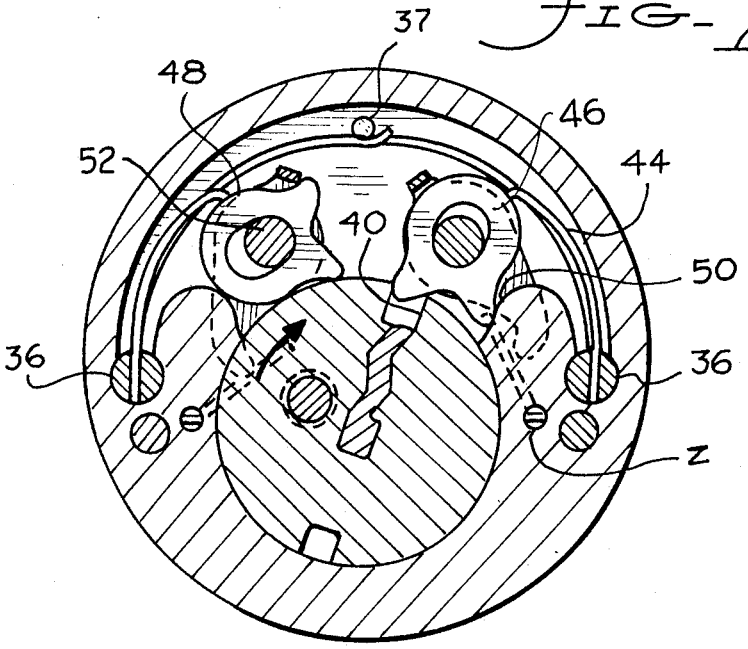

FIG-8-
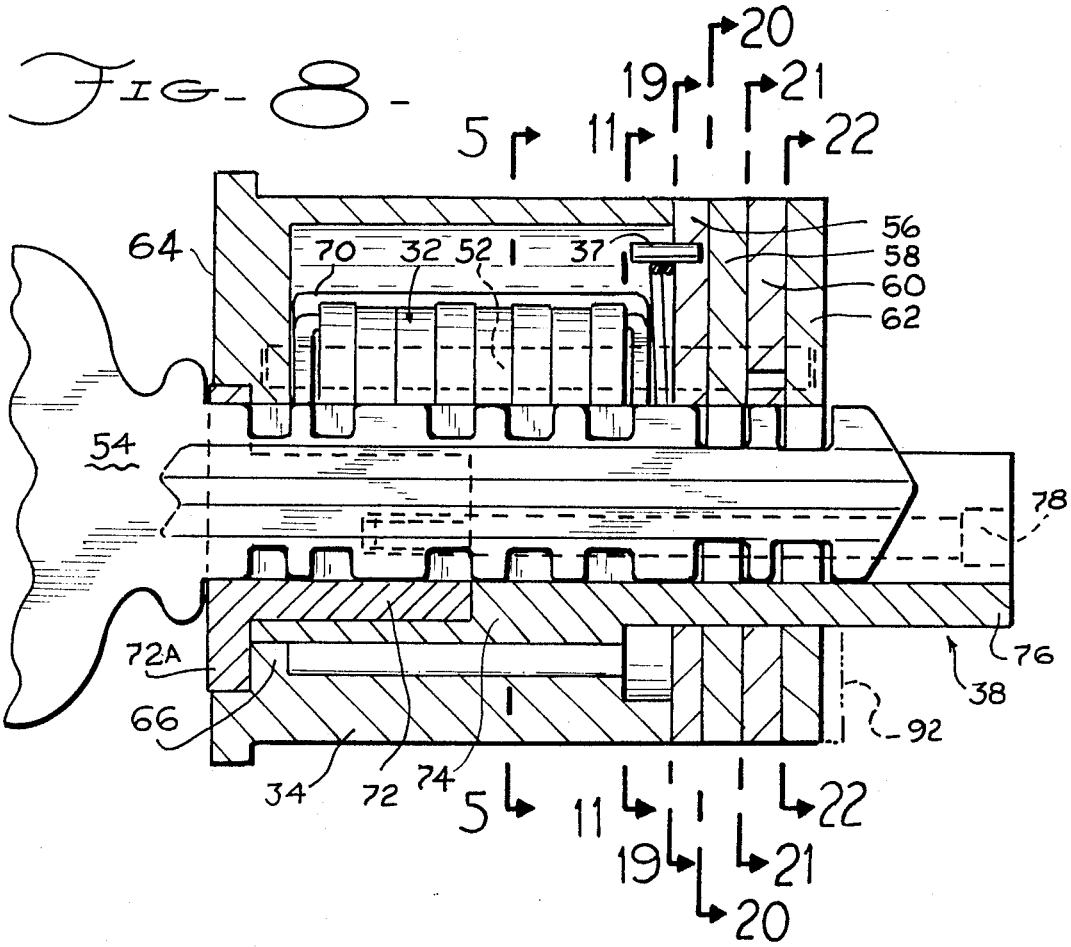
FIG-9-
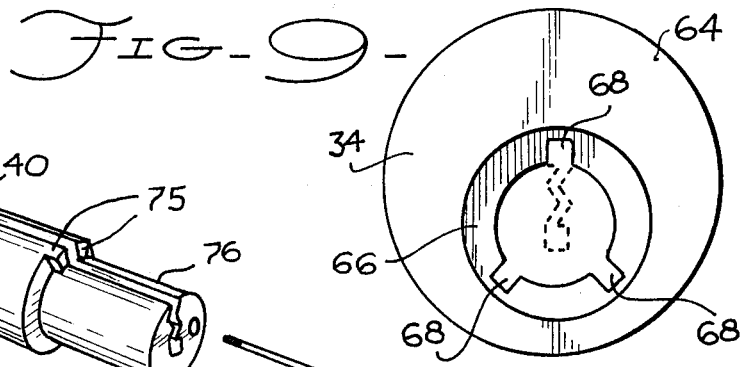
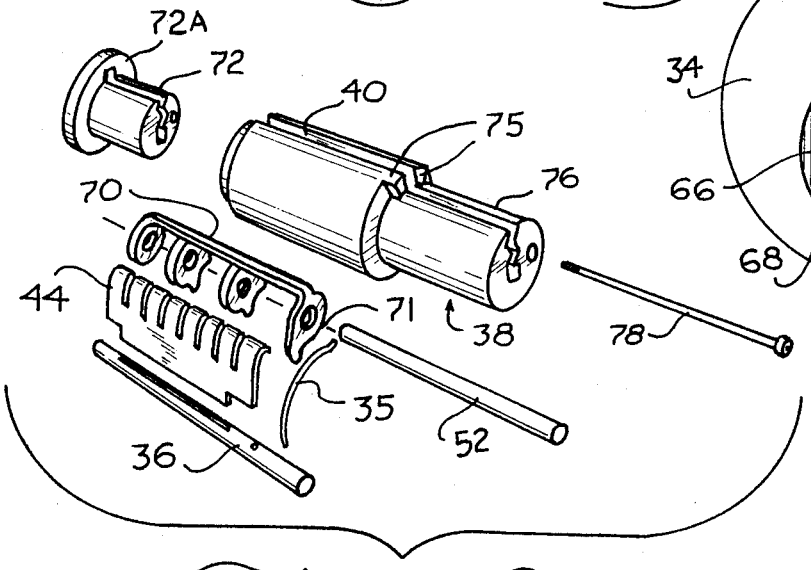
FIG-10-

FIG-11-
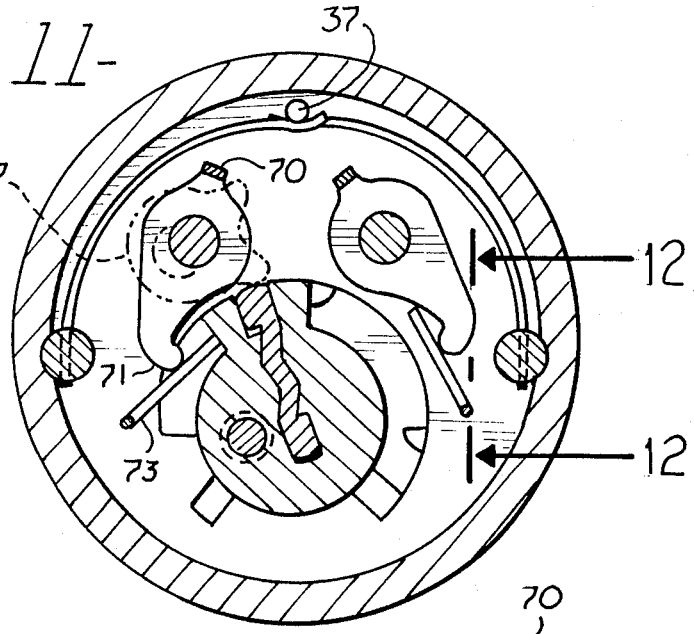
FIG-12-
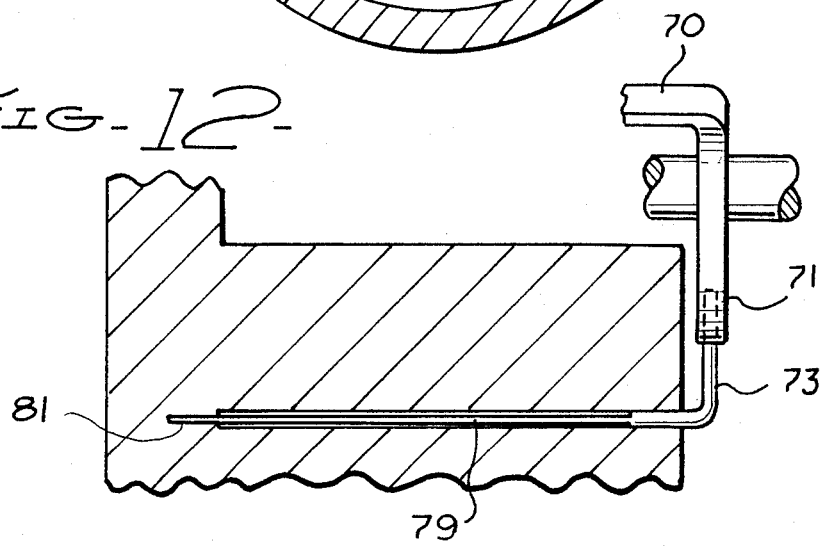
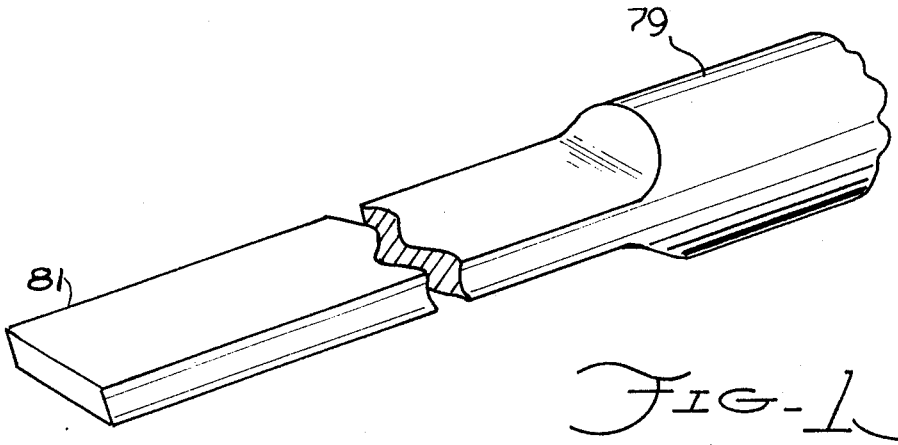
FIG-13-

FIG-14-
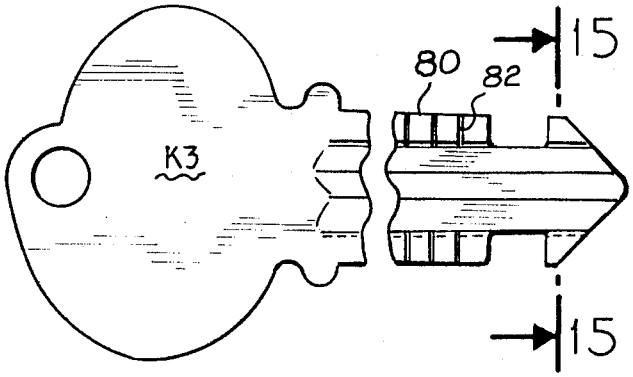
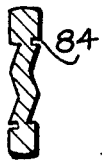
FIG-15-
FIG-16-
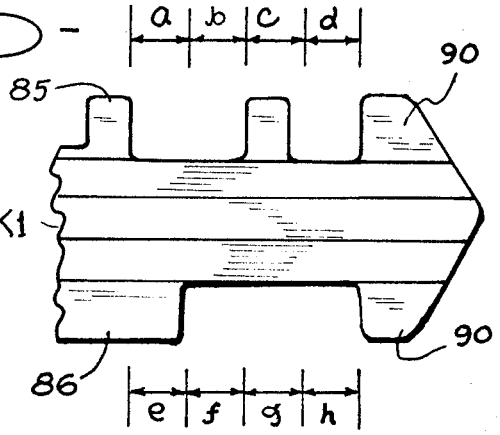
FIG-17-
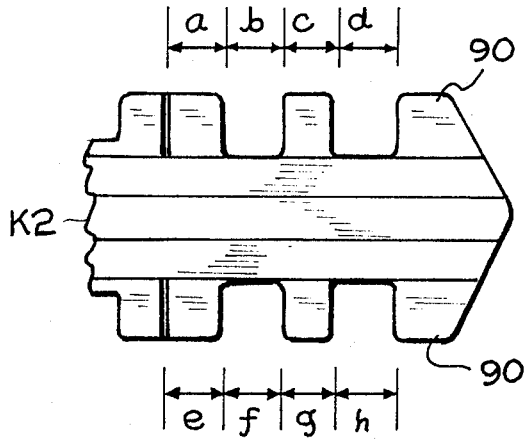
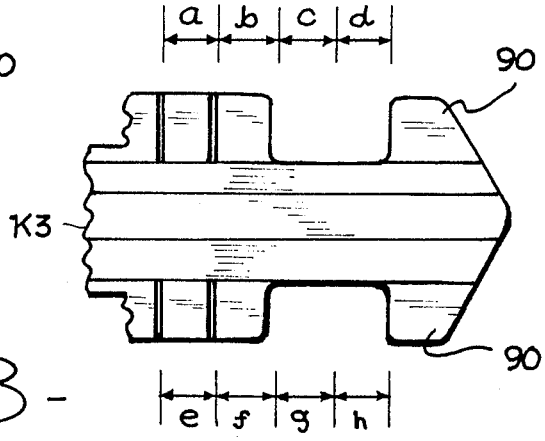
FIG-18-

FIG-23-
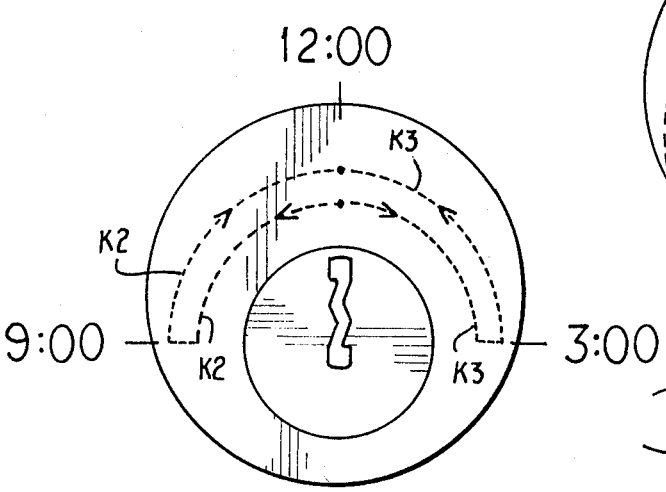
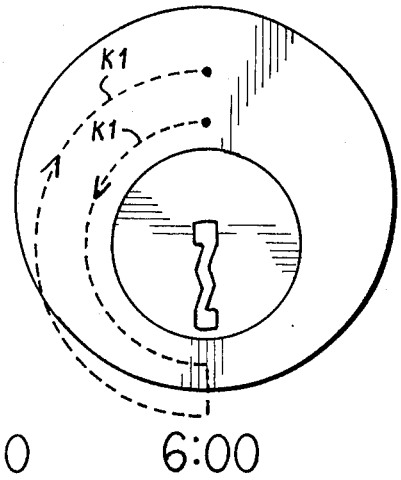
FIG-24-
FIG-25-
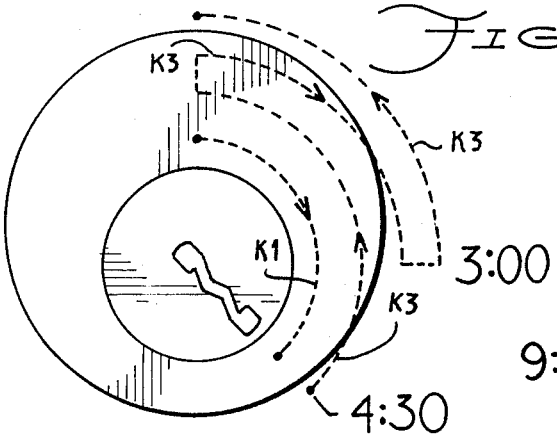
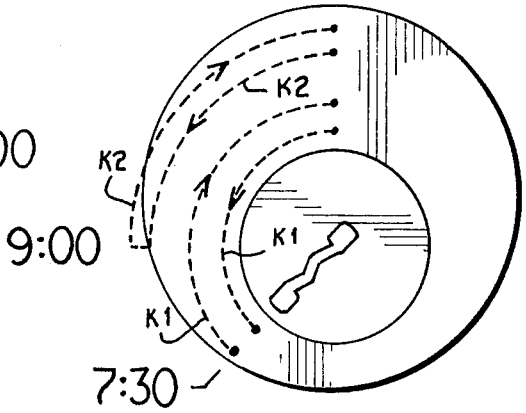
FIG-26-
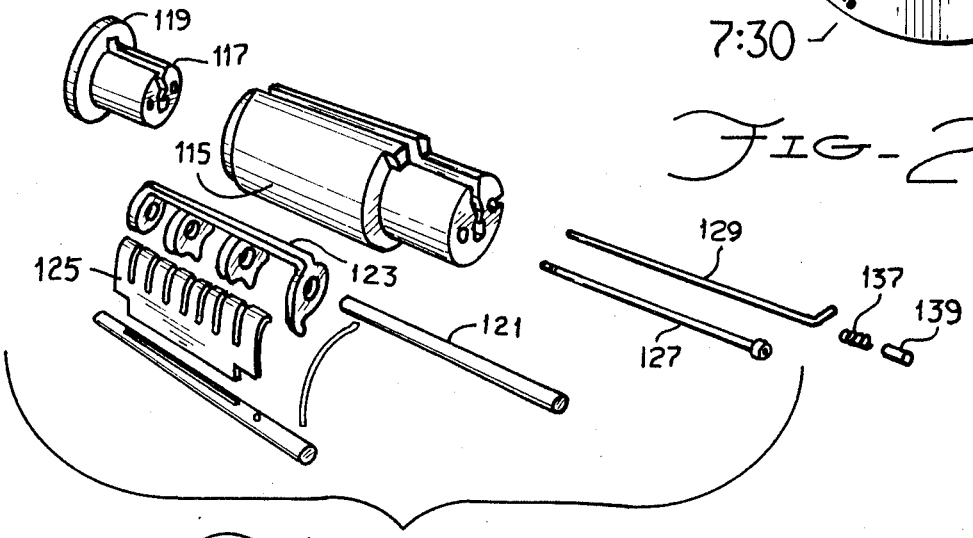
FIG-27-

CYCLE LOCK

BRIEF SUMMARY OF THE INVENTION

This invention relates generally to key operated locks and in particular to novel improvements in cycle locks in which the codes formed by a plurality of rotatable disc tumblers may be readily altered to accomodate a pre-existent key.

The cycle lock described and claimed herein is an improvement over the cycle lock disclosed in my earlier U.S. Pat. No. 3,439,516, issued on Apr. 22, 1969. As explained in that patent a cycle lock is one having at least one group of adjacent disc tumblers rotatable about an generally axial position substantially parallel with the key axis. Each tumbler has a pair of lobes which normally ride on the surface of the lock cylinder or plug. As the plug is rotated each slot in a key in the plug keyway will engage a tumbler lobe and force that tumbler to rotate about a quarter turn to thereby set the tumbler group to the coding of that key. Since a key may normally be removed from the lock only after the tumbler group has been set to that particular key coding, the lock may only be subsequently opened by that same particular key which, in passing under the "set" tumbler group, returns all tumblers to their neitral state with both tumbler lobes riding on the plug surface.

Removal of the key at a certain position at which all tumblers are in a neutral position permits the insertion of a new key which, when rotated back to an operational position will reset all tumblers to the coding of the new key.

Two embodiments of the cycle lock are described. One embodiment, referred to as the "Master Cycle Lock", includes two parallel groups of new and improved tumblers within the lock. One tumbler group is provided to accomodate a "permissive" key such as may be temporarily issued to a hotel guest or which may be the personal property of the tenant; a second or proprietary group may be set and used as a "master" key by the hotel maids or service personnel; and a "grand master" key for use by management personnel uses the proprietary tumbler group and can also readily reset the first group of tumblers to a neutral position that cancels the tumbler code of the permissive or guest key and prepares it to receive a new permissive key. The important advantages of such a lock are that any permissive cycle lock key may be used by a guest until the guest leaves and the lock tumblers are reset by the grand master key and, even more important, a key used by a departed guest cannot be used to reopen his old room when occupied by a new guest, thus greatly improving hotel security by relieving the new guest of the dangers of any unauthorized entering of his room.

The second cycle lock embodiment, referred to as the "Standard Cycle Lock", employs only one group of tumblers for accomodating one key code, such as a residential door lock and/or vehicle lock. When the operational key is inserted in the cycle lock, the tumbler code may be changed to receive a different key code by depressing a pin in the lock face and rotating the key to a certain position at which the tumblers are in a neutral position and at which the key may be removed. A new key inserted into the lock will then reset the tumbler combination to the particular coding on that new key.

Both embodiments of the present cycle lock incorporate numerous advantages over the lock disclosed in my aforementioned U.S. Pat. No. 3,439,516. One improvement is in the shape of the tumblers which are mounted for rotational, radial and angular displacement upon a stationary shaft threaded into an oblong hole near the center of each tumbler to thereby provide better control of the tumbler movement and to permit a radially deeper and more positive engagement of the tumbler lobe into the key slot. Another important advantage over the prior art is the use of a multiple section cylinder or plug which provides accurate plug alignment and tighter tolerances. simplifies the cycle lock production and permits the use of metals having different physical characteristics.

Other improvements include novel housing structures which permit key removal only at specific rotational key positions, novel discriminator discs which establish rotational directions and limits of the various key types, and a positive and mechanically rugged means for preventing the opening of the lock by a key with "unauthorized" coding by the use of a novel spring biased pawl to be described.

These and other objects and advantages will become apparent from the following drawings and specifications.

BRIEF DESCRIPTION OF THE DRAWINGS

In the drawings which illustrates the preferred embodiments of the invention:

FIGS. 1–4 schematically illustrate the operation of cycle lock tumblers by a key slot in the key rotatable plug;

FIGS. 5–7 illustrate the operation of the spring biased lock tumblers in a master cycle lock having two tumbler groups;

FIG. 8 is a sectional elevational view of a lock taken along the lines 8—8 of FIG. 5;

FIG. 9 is a face view of the master cycle lock housing of FIG. 8 with the rotational key plug removed and illustrates the positions of the key removal gates;

FIG. 10 is an exploded perspective view illustrating the components of the master cyclelock rotatable plug, the tumbler bridge, comblike leaf spring and the leaf spring tension adjustment;

FIG. 11 is an elevational view taken along the lines 11—11 of FIG. 8 illustrating details of the bridge pawl;

FIG. 12 is a side view of one end of the tumbler bridge and pawl;

FIG. 13 is an enlarged view illustrating details of the torsion spring portion of the pawl of FIG. 12;

FIG. 14 illustrates a side section of a typical cycle lock key;

FIG. 15 is an end view thereof;

FIGS. 16–18 illustrate typical end coding of grand master, master, and permissive keys, respectively;

FIGS. 23–26 illustrate the various key positions employed in the master cycle lock by a permissive key, master key, and grand master key;

FIG. 27 is an exploded perspective view of the standard cycle lock illustrating the plug, release pin, tumbler bridge, tumbler leaf spring and leaf spring tension adjustment;

DETAILED DESCRIPTION

The Master Cycle Lock

Figure 19:
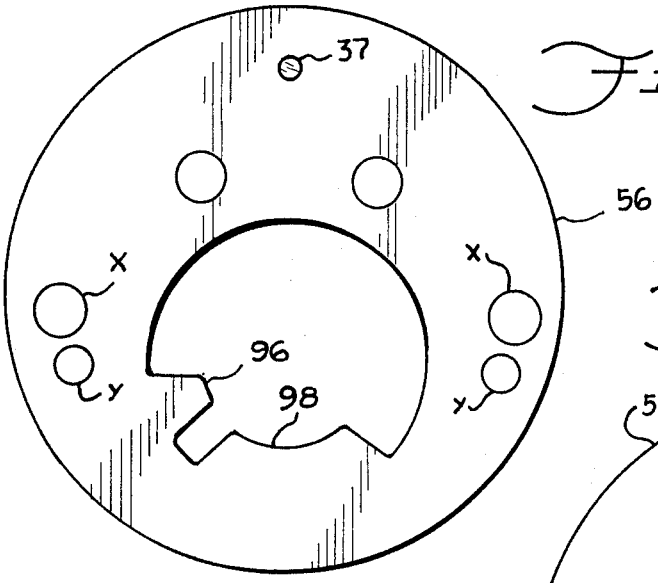
FIGS. 19–22 are elevational views of the discriminator plates taken along the lines 19—19, 20—20, 21—21 and 22—22 respectively, of FIG. 8.

FIGS. 1-4 are elevational views of a cycle lock tumbler 10 and illustrate its rotational, radial and angular movements caused by the rotation of a cylinder or plug 12 having a key slot 14. The tumblers in a typical cycle lock are generally circular as shown and have a thickness that must correspond to the spacings of notches in a key as will be later explained. The tumbler periphery is formed with two lobes 16, 18 that ride on the rotating arcuate surface of the plug as shown in FIG. 1 or, as the plug 12 is rotated, one tumbler may drop into the key slot 14 as shown in FIG. 2.

Each tumbler 10 has a centrally positioned hole 20 that is elongated along an axis midway between the lobes 16, 18, and the elongated holes of a plurality of eight or more identical tumblers are supported side by side on a shaft 22 firmly mounted to the lock housing.

The FIGS. 1-4 provide an illustration of the basic concept of the cycle lock tumbler operation. In FIG. 1, all tumblers on the shaft 22 are in a "Neutral" position with both lobes of all tumblers contacting the periphery of the rotatable plug 12. As the plug is rotated counterclockwise (CCW) as shown by the arrow 24 the key slot 14 approaches the right lobe 18 and as the plug progresses further the lobe 18 will drop into that key slot unless prevented by an unnotched key segment. That is, if a high or unnotched key segment is aligned under a tumbler, the key slot 14 is effectively filled to the plug surface and a tumbler lobe cannot drop into the key slot. The lobe can only drop into the key slot if not already filled by the presence of a key notch.

In FIG. 2, the lobe 18 of tumbler 10 is shown entering the key slot 14 and the tumbler is dropping with respect to the tumbler shaft as it begins to rotate in a direction shown by the arrow 26. Positioned behind tumbler 10 and shown by dashed lines is a second tumbler 28 the two lobes of which remain in their original positions because the tumbler 28 is aligned over an unnotched segment of a key.

FIG. 3 illustrates the situation as the plug has rotated further. The second tumbler 28 remains in its "neutral" position while the tumbler 10 has rotated further so that its lobe 18 is now being withdrawn from the key slot and up to a "locked" position illustrated in FIG. 4.

When the plug 12 is now rotated clockwise (CW) by the same key used for the CCW rotation, all tumblers on the tumbler shaft 22 that were not rotated from their neutral position because of their alignment over an unnotched key segment will remain in their neutral position; all tumblers previously rotated to their locked positions will now be rotated back to their netural position as shown in FIG. 1. Therefore, if all tumblers are initially set in a neutral position, a key with any desired notch pattern could be inserted into the key slot 14 and the plug 12 rotated CCW to set the lock tumblers to the code or notch pattern of the key prior to the removal of the key from the lock. It is now apparent that only that particular key pattern can be used to rotate the plug in a CW direction to open the lock.

FIGS. 5-7 are sectional views taken along the lines 5—5 of FIG. 8 and illustrate interior elements and the tumbler operation of a master cycle lock which, as previously explained, incorporates both a primary and secondary keying system. The secondary keying system, referred to as the permissive tumbler group 30, is operable by a cycle lock key normally loaned to transient guests but may be the personally owned cycle lock key for the guest's vehicle, office or home. The primary keying system employs a proprietary tumbler group 32 operated by a master key normally used by service personnel, and also operable by a grand master key normally held by management personnel. The grand master key also has full control of the lock and can be used to reset the permissive tumbler group 30 to a neutral position and ready to receive a new permissive or guest key.

Illustrated in FIG. 5 is the tubular lock housing 34 having a longitudinal hole for receiving the rotatable lock cylinder or plug 38. The plug 38 has a longitudinal key slot 40 illustrated with an inserted key 42. A tumbler reset slot 43, to be later explained, is longitudinally formed along the plug 38 at a position opposite the opening of the key slot 40. Suspended in a cavity formed in the bore of the housing above the plug, and at positions approximately corresponding to 1:00 and 11:00 o'clock, are the permissive tumbler group 30 and proprietary tumbler group 32, respectively. Longitudinal holes near the sides of the housing support rotatable shafts 36 which are longitudinally slitted to secure leaf springs 44 which exert a downward bias on each individual tumbler in both the permissive and propietary tumbler groups 30, 32. A secondary spring wire, having one end through a radial hole in each of the shafts 36, is looped over a pin 37 to bias the rotation of each shaft and thus provide adjustable leaf spring bias to the tumblers. The tumblers in FIG. 5 are illustrated with the permissive tumbler 46 in a neutral state and the proprietary tumbler 48 in a locked state.

As will be explained later, a permissive or guest key may only be inserted into and removed from the lock at a 12:00 position after its initial introduction and, using the permissive tumbler group 30, operates only between the 12:00 and 3:00 o'clock positions. The master or service personnel key is also inserted into and removed at the 12:00 o'clock position after initial introduction into the lock and, using the proprietary tumbler group 32, operates only between the 12:00 and 9:00 o'clock positions.

It is now apparent from the tumbler configurations of FIGS. 5-7 that the key 42 is a proprietary master key for use by service personnal. As shown in FIG. 5, the key 42 has been inserted at the 12:00 position. The permissive tumbler 46 is in its neutral state with both lobes on the periphery of the plug 38 and the proprietary tumbler 48 is in its locked state. When the plug is rotated CCW as shown in FIG. 6 the left lobe of the proprietary tumbler 48 drops into the key slot 40 and further rotation of the plug to a 9:00 o'clock position is possible because such rotation will only place the tumbler into its neutral state.

FIG. 7 illustrates the results of an attempt to rotate the plug CW between a 12:00 and 3:00 o'clock position. As the plug is rotated CW the left lobe of the permissive tumbler 46, biased downward by the leaf spring 44, will be forced into the key slot 40 to cause the tumbler to rotate CCW about its tumbler shaft. This rotation forces the right lobe of the tumbler 46 against the wall 50 of the body member 36 to stop further rotation of the tumbler and also of the plug. Thus, the key of FIGS. 5 and 6 cannot rotate the plug CW toward the 3:00 position to open the lock.

FIG. 8 is a sectional view of the master cycle lock taken along the lines 8—8 of FIG. 5 and illustrates the housing 34, the proprietary tumbler group 32 on the tumbler shaft 52, a cycle lock key 54 and a group of four discriminator plates 56, 58, 60, 62 attached to the rear of the lock for controlling the directions and limits of the permissive, master, and grand master keys used with the master cycle lock. The discriminator plates will be described later in connection with FIGS. 19–22.

The housing 34 contains a novel feature that limits the positions at which a key may be removed from the lock. As previously mentioned, a permissive or guest key, after its initial insertion into the lock at the 4:30 position, may only be inserted into and removed from the lock at its 12:00 o'clock position and is then operated between the 12:00 and 3:00 o'clock positions; similarly, after initial insertion at the 7:30 position, the service personnel master key may also inserted into and removed at the 12:00 o'clock position but is operated between the 12:00 and 9:00 o'clock positions. Thus, all keys may be inserted or removed only at positions corresponding to 7:30, 12:00 and 4:30 o'clock.

As shown in the sectional view of FIG. 8 and the frontal view of FIG. 9, the tubular housing 34 has a planar face 64 and recessed approximately 0.04 inches behind the face and within the hole receiving the rotatable plug 38 is an annular ring 66 having therein longitudinal slots or key gates 68 at 12:00, 4:30 and 7:30 positions. All three of the key types have clearance notches in both top and bottom edges at the position of the annular ring to permit their rotation with the plug 38 but the notches 68 in the ring 66 permit key withdrawn from the lock at only the 12:00, 4:30 and 7:30 locations.

Illustrated in FIG. 8 by dashed lines is tumbler shaft 52 which is supported at a first end in a recessed hole in planar front face of the lock and at the second end by a similar recessed hole in the rear discriminator plate 62. The shaft 52 not only supports all tumblers of its respective tumbler group, but also supports a tumbler bridge 70 illustrated in FIG. 10.

FIG. 10 is a perspective view illustrating details of the components in the plug 38, the tumbler bridge 70 and the comblike leaf spring 44 and its rotatable shaft 36 with secondary tensioning spring 35 as previously discussed in connection with FIGS. 5–7. The plug 38 includes a key rotatable entrance plug 72A with an annular face plate 74 of a larger diameter. The body of the entrance plug 72 is of a diameter that will fit within the tubular bore of the elongated main plug section 74 which, as illustrated, is coaxial with a plug extension 76. The tumbler shaft 52 is located within the tubular lock body at a position at which the tumblers on the shaft 52 will ride on the surface of the of the main plug section 74 as previously discussed in connection with FIGS. 1–4.

The entrance plug 72 and the main plug section 74 with its extension 76 are formed with the key slot 40, and are telescoped together and secured by a long screw 78 which extends from the rear of the plug through the plug extension 76 and main plug section 74 to screw into a threaded hole in the body of the entrance plug 72.

The key rotatable plug 38 formed by the telescoping members secured together by the long screw 78 provide several advantages in the art. One advantage is that the various components forming the plug may be made of different metals such as stainless steel, brass or other metals or compositions that may exhibit qualities of strength, corrosion resistance, low thermal expansion, etc. Other important advantages are that the telescopic plug assembly 38 is significally easier and less expensive to manufacture, and can be accurately torqued by the screw 78 to achieve a desired rotational freedom without allowing perceptible and objectionable longitudinal movement of the plug relative to the lock body.

FIG. 10 illustrates the tumbler bridge 70 which is mounted for rotation on the tumbler shaft 52. It will be noted that one end of the bridge 70 is provided with a small hook or pawl actuator lever 71 which cooperates with two stop members 75 extending rearward from the main plug section 74 and adajcent the key slot 40 in that section. The purpose of the tumbler bridge is to prevent rotation of the plug 38 at certain tumbler positions by pressing down the end of a torsion biased pawl 73 as illustrated in FIGS. 11–12.

FIG. 10 also illustrates the mounting of the comblike leaf spring 44 which applies a downward bias to each tumbler in a tumbler group. The thin base portion of the leaf spring is inserted into a correspondingly thin longitudinal slot in a shaft 36 which is inserted into a cavity in the cycle lock housing as shown in FIGS. 5–7. A radial hole near one end of the mounting shaft 36 supports the end of a preloading wire spring 35 which can be turned to rotate the shaft 36 for adjusting the bias applied by the leaf spring to the tumblers. To secure the adjustment, the opposite end of the preloading spring 35 may then be hooked over the pin 37 extending from the discriminator plate 57 shown in FIGS. 5 or 10.

FIG. 11 is a cross sectional view taken along the lines 11—11 of FIG. 8 and illustrates, in phantom, the position of a tumbler 77 which, because of the attempted use of an improper key, failed to be rotated into a correct position by the rotation of the plug. Tumbler 77 is now rotated in a counterwise position and its upper or right lobe has contacted and counterclockwise rotated the tumbler bridge 70 which is normally spring biased in a clockwise position by a CCW bias of the torsion spring 73 shown in greater detail in FIG. 12. An identical torsion spring applies a CCW bias to the tumbler bridge associated with the other tumbler group as shown in FIG. 11. As illustrated, the pawl actuator lever 71 at the end of the bridge is shown to have contacted the arm of a pawl 73, the end of which has contacted the stop member 75 to prevent further CCW rotation of the plug 38.

FIGS. 12 and 13 illustrate in detail the pawl 73. The pawl arm is normally positioned so that its end will clear the stop member 75. This arm forms the short leg of an "L" shaped resilient member, the long arm 79 of which forms a torsion spring and loosely fits through a hole in the lock housing wall. The long arm 79, and particularly its end 81, are flattened so that the end 81 may be firmly locked into a slit in the side wall of the lock housing to thereby provide resilient rotation of the long arm 79 and the pawl arm 73.

As illustrated in FIG. 8, four discriminator plates 56, 58, 60, 62 are attached to the rear of the cycle lock housing, each plate having a central circular opening that is coaxial with the rotatable plug 38. The central openings in the various discriminator plates contain various shaped notches that are placed to limit the rotational directions and operative positions of the various types of keys to be used in a cycle lock. Prior to describing the discrimator plates, the various keys will be discussed.

FIGS. 14–18 illustrate typical keys used in a master cycle lock. FIG. 14 is a side elevational view and FIG. 15 is an end view of a cycle lock key such as the permissive or guest key illustrated in detail in FIG. 17. As shown in FIG. 14, the coded top and bottom edges of a key are formed of segments 80, the thickness of each segment corresponding to the thickness of a tumbler. Each individual segment 80 is preferably separated from its adjacent segment by a thin slit 82 and, as shown in the end view of FIG. 15, the top and bottom key edges are "weakened" by a thin horizontal slit 84. Therefore, the coding of a permissive or guest key, a master or service key, or a grand master key may be easily and quickly made from a key blank by merely breaking off desired upper and lower edge segments.

The master or service keys and the permissive or guest keys for use in a cycle lock may have any desired coded edge configurations excepting those end segments designated by the lower case letters, "a" through "h" in FIGS. 16, 17, 18.

To simplify the identification of each cycle lock key, the grand master key will henceforth be identified as key "K1", the master key for service personnel as key "K2", and the permissive or guest key as key "K3".

The upper edge 85 of the grand master key K1 illustrated in FIG. 16 may have any desired segment code configuration, except that the end segments, a, b, c and d, must be configured to be low, low, high, low, respectively, for proper engagement with the various discriminator plates that will be subsequently described. The lower edge 86 of the grand master key must be smooth with no low segments except for the discriminator segments, f, g and h which must be low, or removed, for use in the discriminator plates.

FIG. 17 is an end view of a subordinate master or service key K2 which, as will be subsequently described, uses a separate tumbler assembly and is normally operated between a 12:00 o'clock and 9:00 o'clock position. The top and bottom edges of this key may be identicially coded with any desired segment code so that the key is symmetrical for easy insertion into the lock, or may be coded differently for operation of cycle locks set to the code of a different grand master key. For proper engagement in the four discriminator plates 56, 58, 60, 62, the end segments, a, b, c and d and/or coded segments, e, f, g and h of key K2 must be high, low, high, low, respectively, as shown.

FIG. 18 is a detailed view illustrating the end of a permissive or typical guest key, K3. As with the service key of FIG. 17, the top and bottom edge segments may be formed into any desired code with top segment pattern identical with the bottom segment pattern or with a different patterns for use, for example in a residential or vehicle cycle lock. For proper engagement with the four discriminator plates, the discriminator segments a, b, c and d, and/or segments e, f, g and h of the key K3 must be high, high, low, low, as illustrated.

Figure 20:
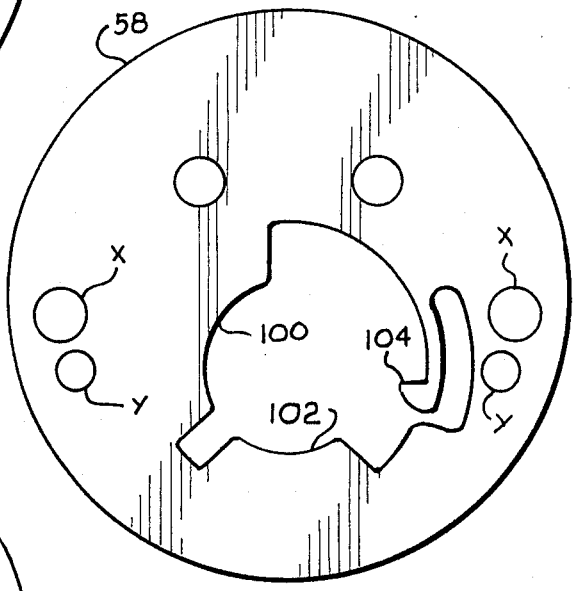
Figure 21:
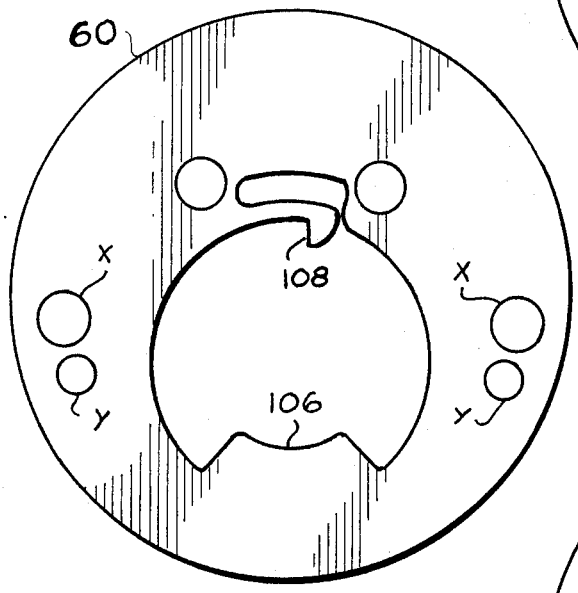
Figure 22:
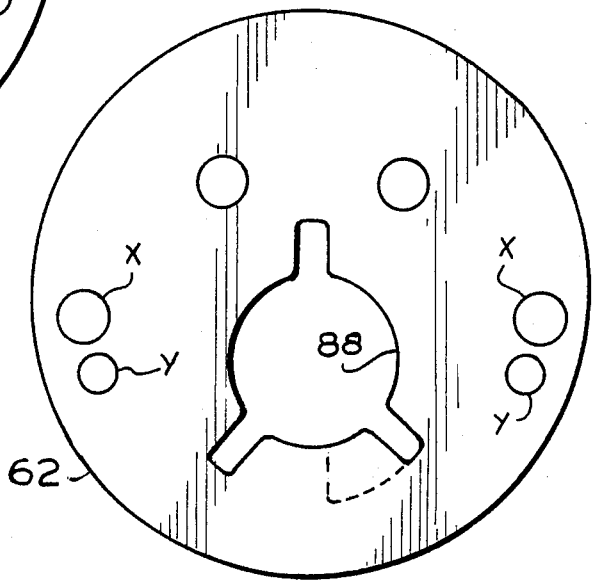

FIGS. 19–22 are front elevational views of the four discriminator plates 56, 58, 60, and 62, respectively, illustrated as shown by the corresponding reference lines of FIG. 8, The rear plate 62 of FIG. 22 is the simplest plate and comprises a central circular opening 88 having a diameter slightly larger than the height dimension of that portion of a key body at the location of removed "d" and "h" segments adjacent the high end segments 90, as shown in FIGS. 16–18. Radially cut to the depth of a circle with a diameter corresponding to the overall height of a key blade with all segments intact are three spaced notches in the circular opening 88 at positions corresponding to 12:00, 4:30, and 7:30 o'clock. Thus, any key that has been inserted at one of these three positions may rotate within the lock but will be retained by their end segments 90 and can be removed only when the end segments are realigned at the appropriate one of the three positions.

As shown in FIG. 22 and in dashed lines in FIG. 8, a small sector 92 is formed on the exterior surface of the plate 62 and between the 4:30 and 6:00 o'clock position and provides a thick segment that will prevent the rotation of any of the keys between the 4:30 and 6:00 o'clock positions. As will be subsequently explained, neither the guest key K3 nor the service master key K2 ever operates within that range but the thickened segment functions as a CCW 6:00 o'clock stop for the grand master key K1 during the resetting of the tumbler assembly used by the service or master key.

FIG. 19 illustrates the discriminator plate 56 and is aligned only with the "a" or "e" slots on keys. The circular opening 94 in this plate has a maximum diameter corresponding to the maximum overall height of a key and has reduced diameter segments 96, 98 between angular positions representing 7:30 to 9:00 o'clock and 4:30 to 7:30 o'clock, respectively. Therefore, a key slotted at its "a" and "e" locations may be completely rotated within the plate 56, but if the key's "a" and "e" positions are high with no notches then the key may only be rotated between 9:00 to 4:30 o'clock and may be inserted or removed at the 7:30 position. A review of the keys of FIGS. 16, 17 and 18 reveals that only the grand master key K1 of FIG. 16 is sloted in the "a" position so that when the key is inserted into the lock with its upper edge 84 adjacent the edge of the circular opening 94, complete rotation is not restricted by the plate. Note, however, that the key K1 of FIG. 16 has no notch in the "e" position so that, if inserted inverted into the lock, its rotation is restricted by the the segments 96, 98.

FIG. 20 illustrates the second discriminator plate 58 which provides rotational limitations to keys having no notches in their "b" and "f" positions. Reduced diameter segments 100, 102 restrict CW rotation of those keys from 12:00 to 4:30 and permit insertion or removal at the 7:30 o'clock position. A resiliently supported pawl 104 formed in the discriminator plate prevents CW rotation of keys with high "b" or "f" positions past the 3:00 o'clock position but permits CCW rotation from the 4:30 position. A review of the key ends of FIGS. 16, 17, 18, reveals that only the permissive key K3 of FIG. 18 has high "b" and "f" segments and that rotation of this key will be limited by the discriminator plate 58.

FIG. 21 illustrates the third plate 60 which restricts rotation to those keys having high "c" and "g" segments, to wit, the master key K2 of FIG. 17 and the grand master key K1 when inserted with the upper edge 84 upright as show in FIG. 16. A reduced diameter sector 106 prevents rotation of those keys with high "c" or "g" segments between 4:30 and 7:30 o'clock and a resiliently supported pawl 108 prevents CW rotation past the 12:00 position but permits CCW rotation from the 4:30 and 7:30 positions.

To summarize, rotation of the guest key K3 of FIG. 18, having high key segments in the positions, a, b, e and f, and notches in the positions, c, d, g and h, is limited only by the patterns of the discriminator plates 56 and 58 of FIGS. 19 and 20, respectively. Thus, the key K3, initially entering the lock at position 4:30, may be rotated CCW from 4:30 to 12:00 and operated by CW rotation from 12:00 to 3:00 o'clock.

The service key K2 of FIG. 17 with high segments at positions, a, c, e and g is affected by the patterns on the discriminator plates 56 and 60 illustrated in FIGS. 19 and 21, respectively. This service key K2 must have a key code on one edge that is identical to that of its grand master key K1, is inserted and removed from the lock only at a 12:00 position, and is rotated CCW from 12:00 to 9:00 positions to operate the cycle lock. This master key K2, being blocked by the pawl 108, may be rotated CW only from 9:00 to the 12:00 o'clock position.

The tip configuration of grand master key K1 illustrated in FIG. 16 reveals that the upper edge 84 is coded with high segments in the "c" position whereas the lower edge 86 has a high segment in the "e" position. The grand master key K1 is operable in the upright position as illustrated in FIG. 16 for setting the proprietary tumbler group and for opening the lock via that group. The key K1 is operated inverted for rotating the key slot CCW from the 12:00 to 4:30 o'clock position for receiving a new guest key K3. In its upright position the grand master key "c" segment is subject only to the pattern of the third discriminator plate 60 of FIG. 21 and is rotatable CCW in the lock between the 4:30 and 7:30 positions and, being restricted by the pawl 108, is rotable CW from 7:30 to 12:00 o'clock. In the inverted position in the lock, the high "e" segment in the master key K1 now becomes a high "a" segment with its rotation limited between 9:00 and 4:30 o'clock by the plate 56 of FIG. 19.

FIGS. 23 through 26 illustrate cycle lock housing faces and rotational movement of the plug by the various keys. FIG. 23 illustrates the rotation during the operation of a guest key K3 and also of the master key K1 or service key K2. During normal operation the guest key K3, having initially been inserted into the lock at the 4:30 position to set the permissive tumbler group from neutral to its unique key code, is inserted into the lock only at the 12:00 position and is rotatable CW to the 3:00 position to open the lock, after which the key must be returned to the 12:00 o'clock position for its removal from the lock. The service master key K2, which does not set the proprietary tumbler group set only by the grand master key K1, is inserted and removed only at the 12:00 o'clock position and is rotatable CCW to the 9:00 o'clock position to open the lock as shown in the sequence of FIGS. 5 and 6.

It is to be noted that, as the guest keys K3 or service keys K2 are rotated from their 12:00 o'clock positions to open the lock, the tumblers in respective tumbler groups are set to their neutral positions as shown in FIG. 1. The return rotation back to the 12:00 position at which the keys may be removed from the lock, resets the respective tumblers in each group to the particular coding of the key.

Thus, the cycle lock is actually a double lock with one set of tumblers for use with one type of key, e.g. K3, and a second tumbler group for use with a second type of key, e.g. K2. The grand master key K1 can operate the proprietary set and can reset either tumbler group to its neutral position and ready to receive new keys with different key codes.

When a particular guest key K3 is no longer required, such as at the time a hotel guest departs and leaves his room locked to his key K3 the grand master key K1 is used to ready the particular lock to accept a new key. It is apparent that the assignment of a new tumbler code after a guest leaves will guarantee that the departed guest's K3 key, nor a copy thereof, can no longer be used to open the lock, hence providing security for subsequent guests.

To reset the permissive tumbler to neutral the grand master key K1 is inserted at the 12:00 o'clock position and the grand master key K1 is then rotated CCW to the 6:00 position. In so doing the tumbler reset slot 43, shown and briefly mentioned in connection with FIG. 5, is rotated CCW from its normal 6:00 position to the 12:00 o'clock position. As the reset slot 43 rotates beneath the permissive tumbler group, the leading lobes of those tumblers not already set to a locked position will drop into the reset slot and thus all tumblers in the group are rotated into a locked position. The grand master key K1 is then rotated CW back to the 12:00 position and the reset slot 43 rotates back down to its 6:00 o'clock position, but in so doing, all tumblers in the permissive group engage the reset slot and are returned in unison to their neutral status as illustrated in FIG. 1. The rotation of the key and plug for this operation is shown in FIG. 24.

The master lock with all permissive tumblers now in their neutral status and with the grand master key K1 at the 12:00 position, may now receive a new guest key by first inverting the key K1 and then rotating it to the 4:30 o'clock position. When key K1 is thus inverted, all key segments under the tumblers are high and the tumblers will therefore remain in their neutral state. The grand master key K1 is then removed and a new permissive key K3 is inserted and rotated CCW over the latching pawl 104 in the discriminator plate 58 and to the 12:00 o'clock position at which point the key may be removed. During the CCW rotation of the guest key, the permissive tumbler group is reset to its locked status and the new key can be removed to leave the permissive tumbler group oriented to the combination characteristics of the new K3 key. It will be noted that the pawl 104 on the discriminator plate 58 of FIG. 20 prevents the CW rotation of guest keys past the 3:00 position. The rotational movement of the key slot for this operation is illustrated in FIG. 25.

The code orientation of both the grand master key K1 and the service master key K2 are necessarily the same, both employing the proprietary tumbler group for opening the cycle lock by CCW rotation from the 12:00 to 9:00 o'clock positions. The service master key K2 is not capable of altering the proprietary tumbler group combination whereas the grand master key K1 may make this change as well as neutralizing the permissive tumbler group and preparing it for a new guest key as discussed above.

FIG. 26 illustrates the rotational movement required of the grand master key K1 to prepare the proprietary tumbler group to accept a new grand master key and service master key K2 with new identical key codes.

The existing grand master key K1 is inserted into the key slot in the 12:00 position, the key being uninverted or with its upper edge 84 at 12:00 o'clock. The key K1 is rotated CCW to the 7:30 position and there removed from the lock. A new grand master key with different coding may then be inserted at this 7:30 position which, when rotated CW to 12:00 o'clock, resets the proprietary tumbler group to the new key code. The grand master key K1 or service master keys K2 having the same key code can then open the cycle lock by CCW rotation between the 12:00 and 9:00 o'clock positions, return CW to 12:00 for removal from the lock.

The Standard Cycle Lock

The master cycle lock described above employs two groups of tumbler, the permissive group for use by keys issued to temporary personnel such as hotel guests, and the proprietary group of tumblers used by master keys normally issued to service personnel and used with grand master keys having full control of the master cycle lock.

The above described master cycle lock tumbler concept also applies to a simpler "standard" cycle lock particularly valuable for household or vehicle use where it may be desired to periodically change a lock combination and/or to use but one key to operate all household and vehicle locks with the ability to change lock and key combinations at will, such as upon the occurances of selling an auto or home, the occupancy of new tenants, etc.

FIG. 27 is a perspective view of a standard cycle lock and illustrates the rotatable main plug 115 with the entrance plug 117 and annular ring 119, all substantially identical to the master cycle lock of FIG. 10. In the standard cycle lock of FIG. 27, there is only one tumbler group having a plurality tumblers such as shown in FIG. 1, each tumbler having an elongated central hole for supporting the tumbler on the tumbler shaft 121. As shown in FIG. 27, the tumbler shaft also supports a tumbler bridge 123 which functions as discussed in connection with FIGS. 11, 12, and a comblike leaf spring 125 connected to a housing member to apply a downward force against each individual tumbler. As with the master cycle lock, a long screw 127 secures together the main plug section 115 and the entrance plug 117. An "L" shaped release pin 129 longitudinally extends through the lock for altering the lock combination as will be subsequently explained.

As noted above, the standard cycle lock contains only one tumbler group which operates identically to one of the groups in the master cycle lock and which is positioned near the 12:00 o'clock position in the lock.

Figure 28:
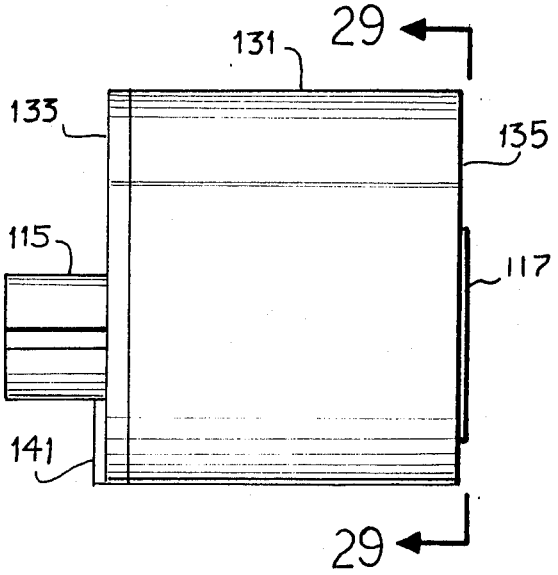
FIG. 28 is a side elevational view of a standard cycle lock.

FIG. 28 is a side elevational view of the standard cycle lock and illustrates the lock housing 131, a portion of the plug 115 extending from a housing back plate 133 and a small portion of the entrance plug 117 extending from the front face of the lock.

Figure 29:
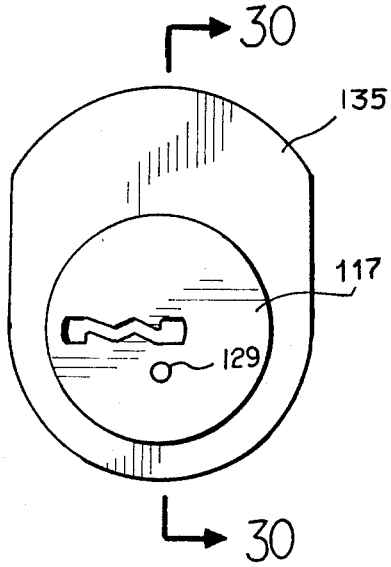
FIG. 29 is a front elevational view of the cycle lock taken along the lines 29—29 of FIG. 28

FIG. 29 is an elevational view of the lock face 135, and illustrates the entrance plug 117 with its key slot, and the end of the release pin 129 extending from the face of the plug 117. Since the standard lock employs only one tumbler group, the lock housing is substantially narrower that of the master cycle lock.

Figure 30:
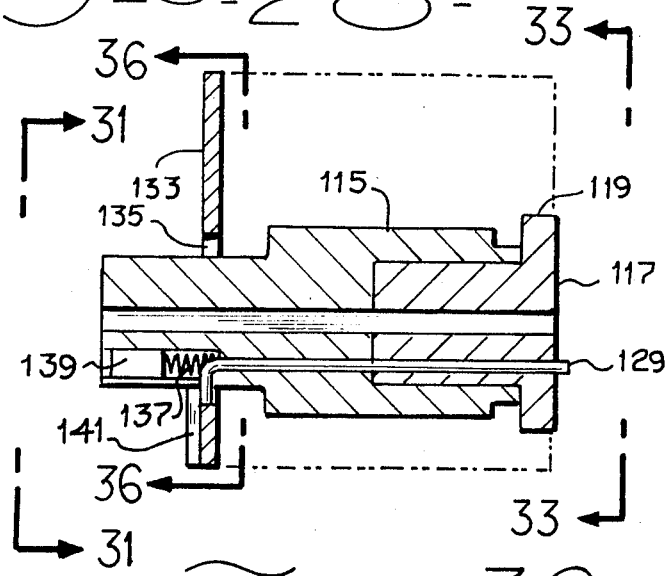
FIG. 30 is a sectional elevational view taken along the lines 30—30 of FIG. 29.
Figure 31:
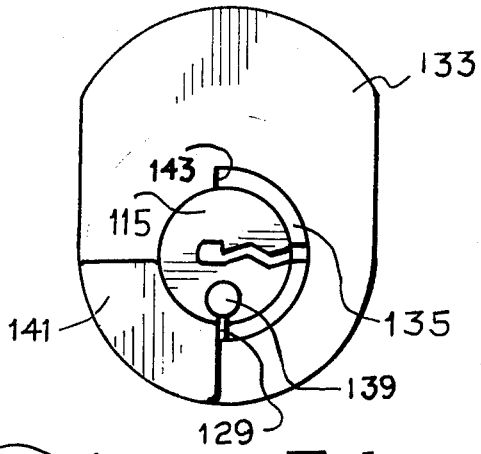
FIG. 31 is a rear end elevational view taken along the lines 31—31 of FIG. 30.

FIG. 30 is a sectional view taken along the lines 30—30 of FIG. 29 and illustrates the position and mounting of the release pin 129. One end the pin extends out beyond the front face of the lock and is longitudinally moveable through a hole in the plug 115 to a point corresponding to the position of the housing back plate 133, at which point the L shaped pin is bend downward into an semi-annular groove 135 surrounding the plug 115 and recessed in the back plate as shown in FIG. 31. The pin 129 is biased forward by a small coil spring 137 held with the longitudinal plug hole by a small screw or friction plug 139.

FIG. 31 is a rear view of the lock taken along the lines 31—31 of FIG. 30 illustrating the rear housing plate 133 with the rotatable plug 115 extending therefrom. The semicircular groove 135 recessed in the plate 133 is shown with the short bent section of the release pin 129 retained in the groove by the plug 139 against the now hidden spring 137. Also illustrated in FIG. 31 is a quarter-circular stop member 141 which is attached to the housing back plate 133 and has a thickness substantially the same as the extension of release pin 129 from the front face of the lock. As will subsequently explained in more detail, the lock plug 115 may be rotated 180° by a proper key while simultaneously rotating the bent rear end of the release pin 129 to the stop 143 at the end of the semicircular groove. However, if desired to change the lock to a new key code, the release pin 129 is depressed against the bias of the spring 137 so that the bent end of the pin is release from the groove stop 143. The lock plug, still with the active key in the key slot, may then be rotated another quarter turn to the point at which the bent end of the release pin 129 is stopped against the edge of the stop member 141. At this point, the active key may be removed and replaced with a new active key which, when returned to its position of normal removal, will reset the tumblers in accordance with the new key code pattern.

In normal operation a key may be inserted and removed only at the 9:00 o'clock position as shown in FIG. 29. In resetting the lock to receive a new key code, the plug is rotated CW from 9:00 to 6:00 after releasing the release pin 129 as explained above. Thus a key can be removed from or inserted into the lock only at the 9:00 or 6:00 o'clock positions.

Figure 32:
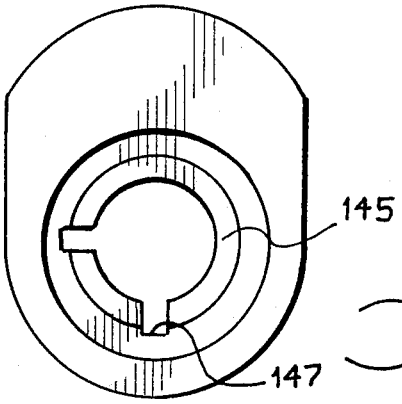
FIG. 32 is a front elevational view of the standard cycle lock housing with plug removed and illustrates the positions of the key removal gates

FIG. 32 illustrates the face end of the lock housing with rotatable plug removed. As with the master cycle lock housing of FIG. 9, the housing of the standard lock is formed with an annular ring 145 which engages a first notch in a key to prevent its removal from the lock. The ring 145 has key gates 147 at the 9:00 and 6:00 o'clock positions to permit lock access by keys only at these points.

Figure 33:
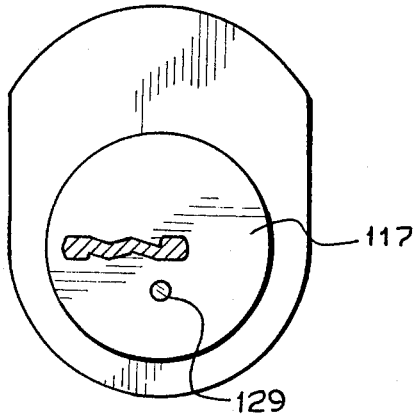
FIGS. 33-35 illustrate the several key positions for operating and for resetting the standard cycle lock.
Figure 36:
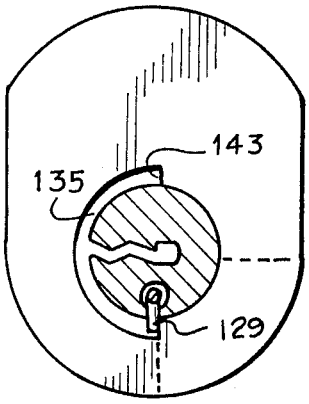
FIGS. 36-38, taken along the lines 36—36 of FIG. 30, are sectional elevational views illustrating release pin positions corresponding the the key positions illustrated in FIGS. 33-35, respectively.
Figure 34:
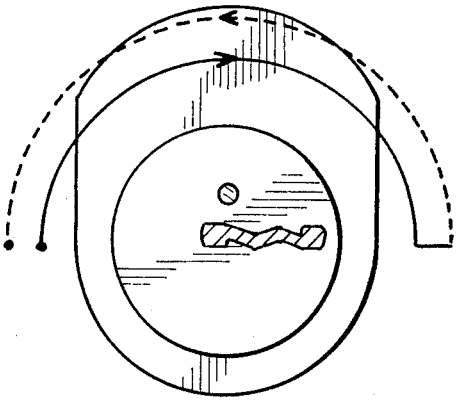
Figure 37:
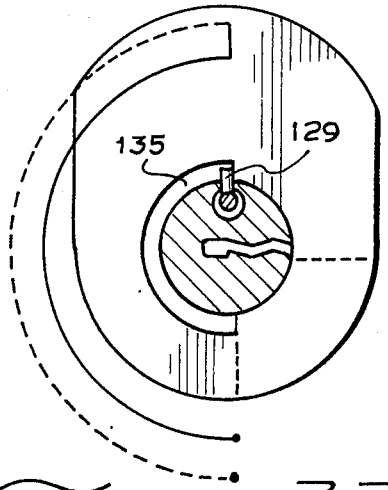
Figure 35:
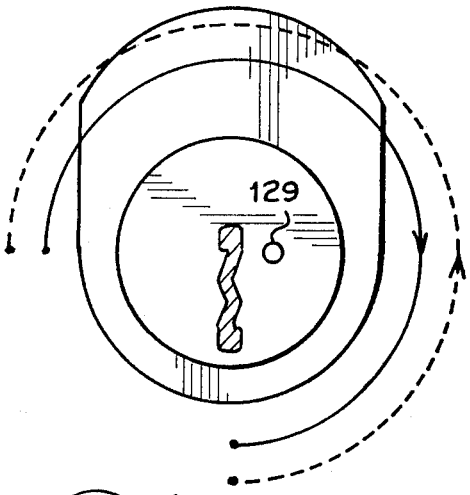
Figure 38:
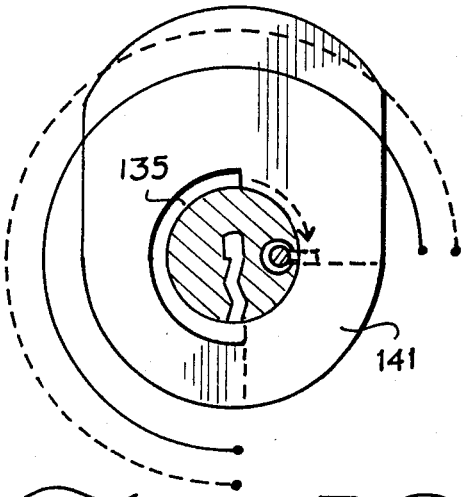

FIGS. 33–35 illustrate various key operating positions of the standard cycle lock and FIGS. 36–38 illustrate the respective corresponding positions of the release pin 129, as taken along the lines 33—33 and 36—36 of FIG. 30. Under normal use, a key in the standard cycle lock may be inserted or removed only at the 9:00 o'clock position as shown in FIG. 33. The release pin 129 is then in the 6:00 position as shown in FIG. 36.

A proper key inserted at position 9:00 will open the lock by its CW rotation to position 3:00 as shown in FIG. 34, but must be rotated CCW back to 9:00 before it can be removed. As the key slot crosses the 12:00 position in its CW rotation and under the tumbler group, all tumblers are reset from the key code to their neutral status, and when the key is subsequently rotated CCW under the tumbler group they are again reset to the key code.

The CW rotation of the key from 9:00 to 3:00 rotates the release pin 129 CW from 6:00 to 12:00 and against the groove stop 143 to thus prevent further rotation of the plug as shown in FIG. 37.

To replace an operating key with a new key having a different key coding, the operating key is inserted at 9:00 and rotated CW to 3:00 o'clock thus settng all tumblers to their neutral state as described above. The release pin 129 is then depressed so that it is released from the semicircular groove and so that the plug may be further rotated CW against the stop 141 as shown in the FIGS. 35 and 38. At this position, the operating key is aligned with the notch 147 in the 6:00 o'clock position in the the annular housing ring 145 of FIG. 32, and the key may be removed to leave the tumblers in their neutral state. A new key with different coding may then be inserted at this 6:00 position, and when crossing the 12:00 o'clock point in a CCW rotation will reset the tumblers to correspond to the new key coding. The key and reset pin rotational movement during this operation is illustrated in FIGS. 35 and 38.

I claim:

1. A cycle lock comprising:

a housing;

a cylindrical plug rotatably mounted in said housing and having a key-receiving slot therein that opens out to the cylindrical surface, said cylindrical plug having a first end and a second end; and a plurality of flat disc-like tumblers, each tumbler in said plurality having an elongated central hole, said plurality being loosely mounted for compound rotational and radial movement on a tumbler shaft engaging each of said elongated holes and secured to said housing parallel with the rotational axis of said cylindrical plug, each of said plurality of tumblers having on its periphery a pair of spaced lobes, said tumblers being in a neutral state when both lobes on a tumbler are in contact with the surface of said cylindrical plug, each of said lobes being configured to enter the key-receiving slot in said plug in the absence of a high segment on a key in said key-receiving slot.

2. The cycle lock claimed in claim 1 further including lock code changing means enabling the insertion of a key into said key-receiving slot at a location where all of said tumblers are in said neutral state, the rotation of said key and said cylindrical plug to a normal key removal location operating to rotate only those tumblers that enter said plug key-receiving slot and are thus rotated from their neutral state on said tumbler shaft to thereby set said plurality of tumblers to a code in accordance with the specific pattern on said key.

3. The cycle lock claimed in claim 2 further including spring means individually biasing each tumbler in said plurality toward the surface of said cylindrical plug.

4. The cycle lock claimed in claim 3 wherein said spring means is a comb-like spring having teeth contacting the edge surface of each of said tumblers in said plurality, the teeth of said spring having a common base secured to a spring shaft supporting an adjustable torque providing second spring for adjusting the bias of said leaf spring.

5. The cycle lock claimed in claim 1 wherein a key insertable into the key slot of said cylindrical plug has high and low key segments at locations that correspond to the locations of the tumblers on said tumbler shaft.

6. The cycle lock claimed in claim 1 further including a tumbler bridge rotatably mounted on said tumbler shaft and overlying said plurality of tumblers, said tumbler bridge being rotated in response to rotation of at least one tumbler in said plurality, the rotation of said tumbler bridge forcing a spring biased pawl into a position to intercept a stop on said cylindrical plug for blocking further rotation of said plug.

7. The cycle lock claimed in claim 6 wherein said spring biased pawl is biased by a resilient torsion spring afixed at one end to said housing.

8. The cycle lock claimed in claim 1 wherein the exterior front face of said housing contains a circular aperture for receiving said cylindrical plug, said aperture having therein an annular key-retaining ring having radial key gate openings at positions defining locations at which keys may be inserted and withdrawn from said key-receiving slots.

9. The cycle lock claimed in claim 8 further including an entrance plug rotatably positioned in the front face of said housing and bearing against said annular key-retaining ring, said entrance plug and the first end of said cylindrical plug being rotatably secured together on each side of said key-retaining ring and thus secured within said housing by a screw longitudinally extending through said cylindrical plug and into said entrance plug.

10. The cycle lock claimed in claim 9 including first and second pluralities of tumblers, each plurality loosely mounted upon first and second parallel tumbler shafts secured to said housing.

11. The cycle lock claimed in claim 10 wherein the interior of said housing is formed to permit the rotation of a tumbler in said first plurality in only a first direction from a neutral state, and a tumbler in said second plurality in only a second direction from its neutral state.

12. The cycle lock claimed in claim 10 further including discriminator means secured to said lock, said discriminator means having a central hole coaxial with said cylindrical plug and having means associated with said central hole for limiting the amount and the direction of rotation of various types of keys insertable into said cylindrical plug.

13. The cycle lock claimed in claim 12 wherein said discriminator means comprises a plurality of plate members attached to said lock and normal to the axis of said cylindrical plug, each of said plurality of plate members having a central hole configured to cooperate with at least one type of key for limiting the amount and direction of rotation of said key.

14. The cycle lock claimed in claim 12 wherein said various types of keys include a permissive key for operating a first plurality of tumblers and normally insertable and removable only at one position and rotatable with said cylindrical plug in a first direction, a service master key for operating a second plurality of tumblers and normally insertable and removable on at said one position and rotatable with said cylindrical plug in a second direction, and a grand master key for operating said second plurality of tumblers and for resetting both first and second pluralities of tumblers to a neutral state for receiving new keys with different codes thereon, the ends of each of said key types having a unique key code alignable with said discriminator plates for cooperation with at least one of said plates.

15. The cycle lock claimed in claim 14 wherein said cylindrical plug has a longitudinal groove on the surface opposite the open key-receiving slot, the plurality of tumblers in said lock being reset by inserting a grand master key in said key slot, rotating said plug in a first direction so that said longitudinal groove engages the lobes of those tumblers in their neutral state and rotates them from their neutral state, counterrotating said cylindrical plug in a second direction to the point of removal of said grand master key whereby the lobes of all tumblers engage said longitudinal groove to return all tumblers in the plurality to their neutral state.

16. The cycle lock claimed in claim 9 wherein said lock includes a single plurality of tumblers for actuation by an active key insertable into said cylindrical plug, and further includes a release pin that longitudinally passes through said cylindrical plug, the first end of said release pin extending from the exterior face of cylindrical plug, the second end of said release pin extending through said plug and forming an L that engages a stop member secured to the back of said housing.

17. The cycle lock claimed in claim 16 wherein the tumbler coding of said lock is changed by the steps of: inserting the active key into the cylindrical plug key slot at the normal point of insertion and removal, rotating said key and plug in a first direction until stopped by the operation of the second end of said release pin against said stop member at which point all tumblers in said plurality will have been rotated into their neutral state, depressing the first end of said release pin to release the second end thereof from said stop member, further rotating said key and plug to a point at which said active key is removable from said plug, removing said active key and inserting a new key with different coding thereon, and rotating said different key in a second direction to its normal point of insertion and removal thereby setting the tumblers in said plurality from their neutral state to the key code of said different key.

* * * * *